US011849870B1

(12) United States Patent
Gong

(10) Patent No.: US 11,849,870 B1
(45) Date of Patent: Dec. 26, 2023

(54) HANGING AUXILIARY DEVICE FOR DOOR MIRROR

(71) Applicant: HUAHONG ART HOME SHARES CO., LTD., Zhejiang (CN)

(72) Inventor: Pinzhong Gong, Zhejiang (CN)

(73) Assignee: HUAHONG ART HOME SHARES CO., LTD., Jinhua (CN)

( * ) Notice: Subject to any disclaimer, the term of this patent is extended or adjusted under 35 U.S.C. 154(b) by 0 days.

(21) Appl. No.: 17/888,519

(22) Filed: Aug. 16, 2022

(30) Foreign Application Priority Data

Jul. 13, 2022 (CN) ..... 202221804680.9

(51) Int. Cl.
*A47G 1/24* (2006.01)
*A47G 1/16* (2006.01)

(52) U.S. Cl.
CPC ..... *A47G 1/24* (2013.01); *A47G 1/1653* (2013.01)

(58) Field of Classification Search
CPC ..... A47G 1/24; A47G 1/202; A47G 1/1653; A47G 25/0614; F16B 7/105; F16B 21/125; F16B 21/06; F16B 21/07; F16B 21/073; F16B 2/10; F16B 2/185; Y10T 403/32501; Y10T 403/59; Y10T 403/591; Y10T 403/595; Y10T 403/60
USPC ..... 248/354.7, 292.12, 478
See application file for complete search history.

(56) References Cited

U.S. PATENT DOCUMENTS

| | | | | |
|---|---|---|---|---|
| 6,575,416 | B1 * | 6/2003 | Avinger | F16B 7/105 248/327 |
| 7,234,671 | B2 * | 6/2007 | Avinger | A01G 5/04 248/339 |
| 8,899,541 | B2 * | 12/2014 | Bixler | A47G 1/164 40/748 |
| 10,070,740 | B2 * | 9/2018 | Jacobs | A47G 1/202 |
| 10,458,594 | B2 * | 10/2019 | Burton | A47G 1/205 |
| 10,537,192 | B2 * | 1/2020 | Fastermann | A47G 1/202 |
| 10,842,299 | B2 * | 11/2020 | Dempsey | A47G 1/164 |
| 2014/0014803 | A1 * | 1/2014 | Kressin | A47G 1/20 248/490 |
| 2019/0032843 | A1 * | 1/2019 | Burton | A47G 1/205 |
| 2020/0281377 | A1 * | 9/2020 | Pyle | A47G 1/10 |

* cited by examiner

*Primary Examiner* — Ingrid M Weinhold

(57) ABSTRACT

The present disclosure discloses a hanging auxiliary device for a door mirror comprising a hanging member and a mounting plate, wherein the hanging member comprises a long strip having a plurality of locating groove groups arranged at intervals, and a single locating groove group comprising two locating grooves arranged along two sides of the long strip and a hook portion; the mounting plate comprises a plate body detachably mounted on a rear side of the door mirror, two bases arranged on one side of the plate body, a sliding channel between the two bases, an anti-falling component arranged at one side of the sliding channel, two elastic members arranged at two sides of the sliding channel; the elastic member comprises an elastic body extending in a curved shape and a clamping head located at an end of the elastic body, and the clamping head is embedded into the locating groove.

8 Claims, 10 Drawing Sheets

HANGING AUXILIARY DEVICE FOR DOOR MIRROR

CROSS REFERENCE OF RELATED APPLICATIONS

This application claims priority to Chinese Patent Application No. 202221804680.9, filed on Jul. 13, 2022, entitled "HANGING AUXILIARY DEVICE FOR DOOR MIRROR", and the contents of which are explicitly incorporated herein by reference.

TECHNICAL FIELD

The present disclosure relates to the technical field of door mirror installation, in particular to a hanging auxiliary device for a door mirror.

BACKGROUND

As its name implies, a door mirror is a mirror suspended on a door, which is widely used in the field of reflecting images. A common door mirror is usually fixed on the door by screws, but it is difficult to adjust the height of the door mirror according to an actual situation of a height of a user. For this purpose, there are many kinds of door mirrors having height adjustment function on the market. Because a mirror body is required to be configured with a mirror surface, the height adjustment function of the door mirror basically is required to be realized through a hanging member suspended on a door plank in order to prevent damage to the mirror body and the mirror surface.

For example, Chinese patent CN202123236518.X discloses a quick-adjusting door mirror hanger including a hanger body, wherein a hanging part is arranged at a top end of the hanger body, and a plurality of hooks are arranged on the hanger body at intervals from top to bottom, the plurality of hooks are formed by direct punching on the hanger body, and notched grooves are correspondingly formed on the hanger body, a gap is formed between the hooks and the hanger body for a pendant to be inserted from top to bottom, at least one mounting hole is provided on the hanger body. In this type, the door mirror is connected with the hanger body with an auxiliary of a hanging piece (fixed on the door mirror), and the hanging piece is provided with holes for hanging the hooks, the hanging piece is hung on the door mirror on the hooks of different heights when the height of the door mirror is required to be adjusted. However, the above technical solution has the following technical defects:

1. because the hooks are required to pass through the holes on the hanging piece, and the hanging piece is fitted on a back of the door mirror, in order to leave no gap between that hanger body and the door mirror, a notch for the hooks to pass through is required to be arranged on the back of the door mirror, the process is more complex, which will increase the processing cost of the door mirror and reduce the structural stability and durability of the door mirror to some extent;
2. the door mirror is heavy, and bearing points for a support of the door mirror are located on the connection between the hooks and the holes; although the hooks are formed by the integral pressing technology, the hooks are prone to fracture after a long time of use, and then the door mirror falls down, there are some safety hazards;
3. during an adjustment of the height of the door mirror, it is necessary to lift up the door mirror, so that the hooks can detach from the holes, and there must be certain adhesion effect in the process, in order to ensure the connection stability between the hanger body and the door plank, the above technical solution is required to fix the hanger body on the door plank through screws or adhesive, which will damage the surface structure of the door plank; and
4. during a hanging of the door mirror, the mirror surface faces a user, the hanging piece is on one side of the door mirror away from the user, there is a blind area of vision in the process of hanging, the alignment of the hooks and the holes cannot be well realized, and the installation is time-consuming and laborious, the structures of the hooks and the holes are easily damaged under the blind area of vision, so that their service life is reduce.

SUMMARY

In order to solve the above problems, the present disclosure provides a hanging auxiliary device for a door mirror.

The technical solution provided by the present disclosure is: a hanging auxiliary device for a door mirror for assisting in hanging the door mirror to a door plank, wherein the hanging auxiliary device comprises a hanging member and a mounting plate, wherein the hanging member comprises:

a long strip extending in a flat thin strip shape and having a plurality of locating groove groups arranged at intervals along a length direction, and a single locating groove group comprising two locating grooves arranged symmetrically or offset along two sides on a width direction of the long strip, and upper and lower ends of the locating groove being a guiding end and a limit end; and a hook portion integrally mounted to an upper end of the long strip;

the mounting plate comprises:

a plate body detachably mounted on a rear side of the door mirror;

a base, there are two bases which are arranged on one side of the plate body at left and right intervals;

a sliding channel between the two bases, through which the long strip passes; an anti-falling component arranged at one side of an extending direction of the sliding channel for preventing the long strip from falling out of the sliding channel;

and an elastic member, there are two elastic members which are arranged at left and right sides of the sliding channel;

the elastic member comprises:

an elastic body extending in a curved shape and having one end fixed to the base or the anti-falling component; and a clamping head located at an extended end of the elastic body;

during the long strip passing through the sliding channel from top to bottom, the elastic body has an expanded state and a normal state; in the expanded state, the clamping head abuts on a side on the length direction of the long strip through an elastic deformation of the elastic body; and in the normal state, the elastic body restores the deformation, and the clamping head is adaptively embedded into the locating groove; and the guiding end is used to assist in guiding the clamping head away from the locating groove, and the limit end is used to limit a downward movement of the clamping head.

Several alternative modes are also provided below, but they are not an additional limitation to the above overall solution, but only a further supplement or optimization. On the premise of no technical or logical contradiction, each alternative mode can be combined separately for the above overall solution, or multiple alternative modes can be combined.

In some embodiments, two locating grooves in the single locating groove group are symmetrically arranged on two sides along the width direction of the long strip, and the long strip passes through the sliding channel along a vertical direction, two clamping heads are bilaterally symmetrical along a centerline in the length direction of the long strip.

In some embodiments, the anti-falling component comprises two sets of limit blocks arranged at upper and lower intervals, and one set of the limit block comprises two limit blocks fixedly mounted on two bases respectively.

In some embodiments, a lower end of the strip is provided with a plug, and two sides in a length direction of the plug are shrunk inward from top to bottom until a tip end is formed at a lowest end of the plug.

Here, in the installation process of the plate body, it is necessary to determine the swing direction of the sliding channel first, and ensure that the sliding channel is placed in the vertical direction, at this time, the upper and lower ends of the sliding channel are the plug inlet and the plug outlet respectively. When the plate body has been installed, the long strip is inserted from the side of the plug inlet from top to bottom (the width of the long strip is generally slightly smaller than the width of the sliding channel). It should be noted that, before the long strip is inserted, an orientation of the hook portion must be confirmed, and the hook portion should be placed toward a side facing away from the door mirror, so that the hook portion can be hung onto the door plank later. An edge in a front side of the door mirror is generally provided with an outer frame having a closed ring shape, and an inner side of the outer frame is provided with a mirror surface which faces outward when the door mirror is hung onto the door plank by the hanging auxiliary device in this embodiment. Of course, although the door mirror is chosen to be described as a cooperating hanging object using the hanging auxiliary device in this embodiment, any other substantially flat article (or an article having a substantially flat back) may be used as a cooperating hanging object using the hanging auxiliary device, including works of art, crafts, diplomas, etc.

In some embodiments, a bottom of the locating groove is configured to be an abutment inner end, and the guiding end extends outward from an upper end of the abutment inner end in a gentle slope, and the limit end comprises a lower sealing slope, a valley bottom end and a peak end respectively disposed on both inner and outer sides of the lower sealing slope, wherein the valley bottom end is located at a lower end of the abutment inner end, and the valley bottom end has a lower horizontal height than the peak end.

In some embodiments, the hook portion comprises an upper transverse portion which is vertically bent and extended from an upper end of the long strip to one side, and a stop portion which is downwardly bent and extended from a free end of the upper transverse portion, a lower end of the upper transverse portion is integrally provided with a leading portion which is folded outwardly, the upper transverse portion, the stop portion, and the long strip together surround to form a door plank bayonet opening with an opening downward.

In order to facilitate the processing and the final molding, a bending position is generally provided at the connecting position of the long strip and the upper transverse portion, and notches are respectively provided on two sides of the bending position along the extending direction of the long strip and the upper transverse portion, the notches correspond to a projection of the anti-falling component and the elastic member in a vertical direction.

Here, the notches are designed to assist the bending with the bending position, and most importantly, if the hanging member is required to be detached from the mounting plate, due to the design of the limit end in the locating groove, the hanging member can only be detached from above the mounting plate. Therefore, when an uppermost end of the long strip passes through the sliding channel, the hook portion is bound to contact with the anti-falling component as well as the elastic member, at the same time, the notches are provided for the anti-falling component and the elastic member to pass through, so that the hanging member can be smoothly detached from above the mounting plate.

In some embodiments, the upper and lower ends of the clamping head are respectively named as a clamping upper end and a clamping lower end. When the clamping head is embedded into the locating groove, the clamping upper end abuts on an inner wall of the guiding end, and the locking lower end abuts on the valley bottom end.

In some embodiments, the plate body is provided with a plurality of mounting holes arranged at intervals, and the mounting holes are used for fastening and mounting the plate body to a rear side of the door mirror with fasteners. It should be noted that the fasteners herein may employ, but are not limited to, screws, nails, rivets, clips, etc., which cooperate with the mounting holes to form a detachable connection, a fixed connection, and/or combinations thereof. In practical applications, for convenience, a self-tapping screw is generally adopted to carry out the installation.

In some embodiments, the plate body is provided with a plurality of mounting holes arranged at intervals, and the mounting holes are used for fastening and mounting the plate body to a rear side of the door mirror with fasteners. In order to make the connection between the plate body and the rear side of the door mirror more stable, a plurality of extension plates are generally disposed on a peripheral side of the main plate body, and the mounting holes are distributed at a center of gravity of each extension plate.

In some embodiments, left and right sides of the sliding channel are respectively provided with an opening for elastic deformation and displacement of the elastic body, and the plate body is provided with a through hole communicating with the sliding channel. Here, the opening is also generally connected to the through hole, which is equivalent to the through hole covering the entire or most of the area where the opening and the sliding channel are located, and thus the production cost is effectively reduced without affecting the overall strength of the plate body.

Working principle: after the plate body is fixed on the rear side of the door mirror through the self-tapping screw and the mounting hole, i.e. the long strip of the hanging member can be inserted into the sliding channel from an end of the plug inlet from top to bottom and the direction of the hook portion at this time is ensured to face away from a side of the mirror surface. At this time, the tip end of the plug will first pass through the plug inlet and enter into the sliding channel. Since two sides in the length direction of the plug are contracted inward from top to bottom, the plug can smoothly enter into the sliding channel when the long strip is further displaced downward. When the plug is completely inserted into the sliding channel, the locating groove closest to the plug is immediately inserted into the sliding channel. When the tip end moves downward to the position of the clamping head, the clamping upper end of the clamping head first contacts the tip end, since the clamping upper end of the clamping head is guided in a gentle arc shape, when the tip end moves further downward, the tip end and the side wall of the plug will abut against and apply a pressing force to the clamping head to expand outwardly, and the elastic body is deformed after being pressed, and enters into the opening. When the long strip continues to be displaced downward and the locating groove is displaced to the position of the clamping head, the clamping head loses the pressing force applied by the side wall of the plug at the moment when the clamping head reaches the locating groove. At this time, the elastic body restores the elastically deformation, and the clamping head springs back and enters into the locating groove. The upper and lower ends of the locating groove are a guiding end and a limit end, respectively. At this time, there are two cases:

case 1: the door mirror has reached a predetermined height, and it is not necessary to adjust the relative positions of the long strip and the mounting plate. At this time, the force bearing point overcoming the gravity of the door mirror and the mounting plate will be shifted to the connection position of the locating groove and the clamping head. In general, a plurality of mounting plates are installed on the rear side of the door mirror, and each mounting plate is correspondingly provided with a hanging member, so that the force is distributed continuously, and the force distributed evenly across each hanging auxiliary device is not large. When the door mirror has no additional force, the elastic members on each mounting plate cannot be elastically deformed by gravity alone, so that the clamping head cannot be separated from the locating groove, and the height of the door mirror can be finally positioned; and case 2: when the door mirror has not reach the predetermined height, it is optional to continue the downward displacement of the long strip relative to the mounting plate (as described in case 1, the force acting on a single hanging auxiliary device is not large, When it is necessary to push the long strip to continue the displacement, it is relatively easy to perform the displacement only by human force), at this time, the clamping upper end of the clamping head is separated from the locating groove by a guide of the guiding end, and the clamping lower end is also separated from the limit end, and the elastic body continues to be elastically deformed after being pressed until the latching head enters into the next locating groove.

Compared with the prior art, the present disclosure has the following beneficial effects:

1. the structure provided by the present disclosure is simple, and the long strip-shaped locating groove and the clamping head on the mounting plate are used to realize the locating of the door mirror, so there is no need to open an additional groove on the rear side of the door plank, the production cost is low, and the structure of the door plank will not be damaged;
2. since the force applied to the clamping head is associated with the elastic member as a whole, and the elastic member as a whole is inclined to be vertically placed, no breakage occurs even if it is hung for a long time, and the safety performance is high;
3. if it is necessary to adjust the height of the door mirror, it is only necessary to press by hand and make the long strip move downward until the clamping head is engaged into the locating groove in a proper position, after the position is determined, the hanging auxiliary device together with the door mirror is hung onto the door plank; and
4. during an adjusting of the position of the long strip, the whole process can be seen, and it does not cost much effort, is simple and convenient, and is more suitable for modern hanging of door mirrors.

BRIEF DESCRIPTION OF THE DRAWINGS

In order to more clearly explain the embodiments of the present disclosure or the technical solution in the prior art, the following will briefly describe the drawings which are necessary for the description of the embodiments or the prior art. Obviously, the drawings in the following description are only some embodiments of the present disclosure, and for those skilled in the art, other drawings may also be obtained from the structure shown in the drawings on the premise of no creative labor.

Figure 1:
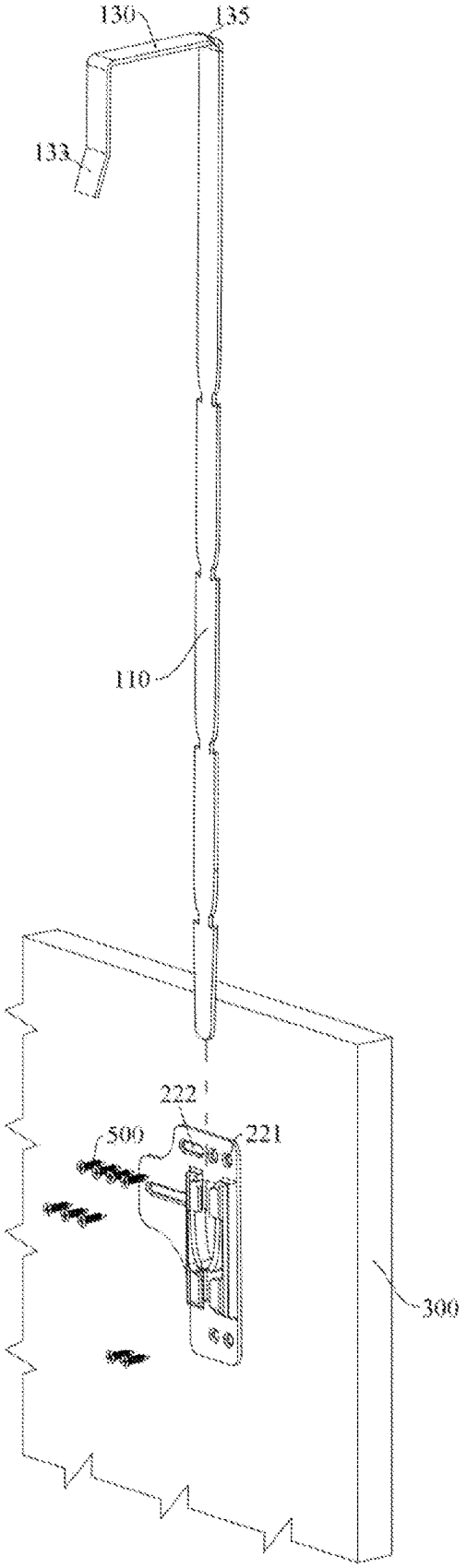
FIG. 1 is an overall exploded view of a hanging auxiliary device according to the present disclosure installed on a partial door mirror.

Reference sighs: 100—hanging member, 110—long strip, 111—locating groove, 1111—guiding end, 1112—abutment inner end, 1113—valley bottom end, 1114—peak end, 1115—lower sealing slope, 120—plug, 121—tip end, 130—hook portion, 131—upper transverse portion, 132—stop portion, 133—leading portion, 134—door plank bayonet opening, 135—bending position, 200—mounting plate,

210—main plate body, 220—extension plate, 221—first mounting hole, 222—second mounting hole, 223—third mounting hole, 224—fourth mounting hole, 230—base, 240—upper limit block, 250—elastic member, 251—elastic body, 252—clamping head, 2521—clamping upper end, 2522—clamping lower end, 260—lower limit block, 270—through hole, 271—opening, 280—plug inlet, 290—plug outlet, 300—door mirror, 310—outer frame, 320—mirror surface, 400—door plank, 500—fastener.

The realization of the purpose, the functional characteristics and the advantages of the present disclosure will be further described with reference to the attached drawings in combination with the embodiments.

DESCRIPTION OF THE EMBODIMENTS

In the following, the technical solution in the embodiments of the present disclosure will be clearly and completely described with reference to the drawings in the embodiments of the present disclosure. Obviously, the described embodiments are only one part of the embodiments of the present disclosure, and not all embodiments. Based on the embodiments in the present disclosure, all other embodiments obtained by those skilled in the art without making creative labor belong to the scope of the protection of the present disclosure.

It should be noted, all directional indications (such as up, down, left, right, front, back . . . ) in the embodiments of the present disclosure only are used to explain the relative positional relationship between the components in a particular attitude (as shown in the drawings), if the particular attitude changes, the directional indications change accordingly.

In addition, the description of "first," "second," etc. in the present disclosure is used for descriptive purpose only and is not to be understood as indicating or imply their relative importance or implicitly indicate the number of indicated technical features. Thus, features defined with "first," "second" may explicitly or implicitly include at least one such feature. In addition, the technical solutions among the various embodiments may be combined with each other, but must be based on the implementation by those skilled in the art. When the combination of the technical solutions is contradictory to each other or cannot be realized, it should be considered that the combination of the technical solutions does not exist and is not within the protection scope of the present disclosure.

Referring to FIGS. 1-15, the present disclosure relates to a hanging auxiliary device for a door mirror, which is used to assist in hanging a door mirror 300 onto a door plank 400, and includes a hanging member 100 and a mounting plate 200, wherein the hanging member 100 includes:

a long strip 110 extending in a flat thin strip shape has a plurality of locating groove groups arranged at intervals along a length direction, and a single locating groove group includes two locating grooves 111 arranged symmetrically or offset along two sides on a width direction of the long strip 110, and upper and lower ends of the locating groove 111 are a guiding end 1111 and a limit end; and a hook portion 130 integrally mounted to an upper end of the long strip 110;

the mounting plate 200 includes:

a plate body detachably mounted on a rear side of the door mirror 300;

a base 230, there are two bases which are arranged on one side of the plate body at left and right intervals;

a sliding channel between the two bases 230, through which the long strip 110 passes;

an anti-falling component arranged at one side of an extending direction of the sliding channel for preventing the long strip 110 from falling out of the sliding channel; and an elastic member 250, there are two elastic members which are arranged at left and right sides of the sliding channel;

the elastic member 250 includes:

an elastic body 251 extending in a curved shape and having one end fixed to the base 230 or the anti-falling component; and a clamping head 252 located at an extended end of the elastic body 251;

during the long strip 110 passing through the sliding channel from top to bottom, the elastic body 251 has an expanded state and a normal state; in the expanded state, the clamping head 252 abuts on a side on the length direction of the long strip 110 through an elastic deformation of the elastic body 251; and in the normal state, the elastic body 251 restores the deformation, and the clamping head 252 is adaptively embedded into the locating groove 111; and the guiding end 1111 is used to assist in guiding the clamping head 252 away from the locating groove 111, and the limit end is used to limit a downward movement of the clamping head 252.

In order to ensure the connection strength and the stability of the entire structure, the hanging member 100 is generally formed by integrally pressing a metal plate, preferably a rigid material, and can have certain bending property under a strong force. Of course, in practical applications, the hanging member 100 can also be made of other materials, such as plastic, matrix material or any other material that can meet the load bearing requirements after being formed, ground/coated.

In this embodiment, two locating grooves 111 in the single locating groove group are symmetrically arranged on two sides along the width direction of the long strip 110, and the long strip 110 passes through the sliding channel along a vertical direction, two clamping heads 252 are bilaterally symmetrical along a centerline in the length direction of the long strip 110.

In addition, in this embodiment, the anti-falling component includes two sets of limit blocks arranged at upper and lower intervals, and the set of the limit block includes two limit blocks fixedly mounted on two bases 230, respectively; an upper limit block 240 and a lower limit block 260 are two limit blocks mounted on the same base 230 and arranged at upper and lower intervals; and the anti-falling component adopts the design of two limit block groups and the four limit blocks can effectively prevent the long strip 110 from coming out of the sliding channel forward during sliding. Moreover, the two limit blocks in the same limit block group adopt a spacing design in order to enable the hanging member 100 to be detached from the mounting plate 200 later, and a specific detaching manner will be explained below.

As a preferred embodiment of the present embodiment, a lower end of the strip 110 is provided with a plug 120, and two sides in a length direction of the plug 120 are shrunk inward from top to bottom until a tip end 121 is formed at a lowest end of the plug 120.

Here, in the installation process of the plate body, it is necessary to determine the swing direction of the sliding channel first, and ensure that the sliding channel is placed in the vertical direction, at this time, the upper and lower ends of the sliding channel are the plug inlet 280 and the plug outlet 290 respectively. When the plate body has been installed, the long strip 110 is inserted from the side of the plug inlet 280 from top to bottom (the width of the long strip 110 is generally slightly smaller than the width of the sliding channel). It should be noted that, before the long strip 110 is inserted, an orientation of the hook portion 130 must be confirmed, and the hook portion 130 should be placed toward a side facing away from the door mirror 300, so that the hook portion 130 can be hung onto the door plank 400 later. The overall profile of the hanging member 100 appears an "L" shape. An edge in a front side of the door mirror 300 is generally provided with an outer frame 310 having a closed ring shape, and an inner side of the outer frame 310 is provided with a mirror surface 320 which faces outward when the door mirror 300 is hung onto the door plank 400 by the hanging auxiliary device in this embodiment. Of course, although the door mirror 300 is chosen to be described as a cooperating hanging object using the hanging auxiliary device in this embodiment, any other substantially flat article (or an article having a substantially flat back) may be used as a cooperating hanging object using the hanging auxiliary device, including works of art, crafts, diplomas, etc.

Then, a bottom of the locating groove 111 is configured to be an abutment inner end 1112, and the guiding end 1111 extends outward from an upper end of the abutment inner end 1112 in a gentle slope. The limit end includes a lower sealing slope 1115, a valley bottom end 1113 and a peak end 1114 respectively disposed on both inner and outer sides of the lower sealing slope 1115, wherein the valley bottom end 1113 is located at a lower end of the abutment inner end 1112, and the valley bottom end 1113 has a lower horizontal height than the peak end 1114. Here, the design of the valley bottom end 1113 and the peak end 1114 is equivalent to designing the limit end as a barbed bayonet, so that the long strip 110 can only move downward relative to the mounting plate 200, but cannot move upward relative to the mounting plate 200, which may assist in determining the mounting direction of the strip 110 and the mounting direction of the mounting plate 200.

In this embodiment, the hook portion 130 includes an upper transverse portion 131 which is vertically bent and extended from an upper end of the long strip 110 to one side, and a stop portion 132 which is downwardly bent and extended from a free end of the upper transverse portion 131. A lower end of the upper transverse portion 131 is integrally provided with a leading portion 133 which is folded outwardly. The upper transverse portion 131, the stop portion 132, and the long strip 110 together surround to form a door plank bayonet opening 134 with an opening downward.

In order to facilitate the processing and the final molding, a bending position 135 is generally provided at the connecting position of the long strip 110 and the upper transverse portion 131, and notches (not depicted) are respectively provided on two sides of the bending position 135 along the extending direction of the long strip 110 and the upper transverse portion 131. The notches correspond to a projection of the anti-falling component and the elastic member 250 in the vertical direction.

Figure 2:
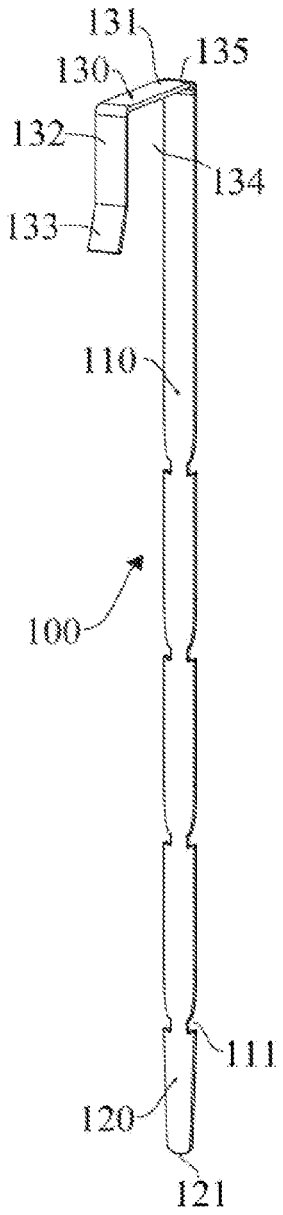
FIG. 2 is a structural diagram showing an overall axis side of a hanging member in the present disclosure.
Figure 3:
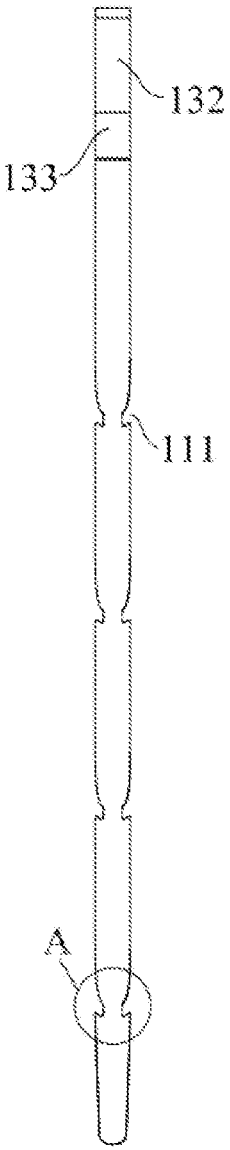
FIG. 3 is an overall front view of the hanging member in the present disclosure.
Figure 4:
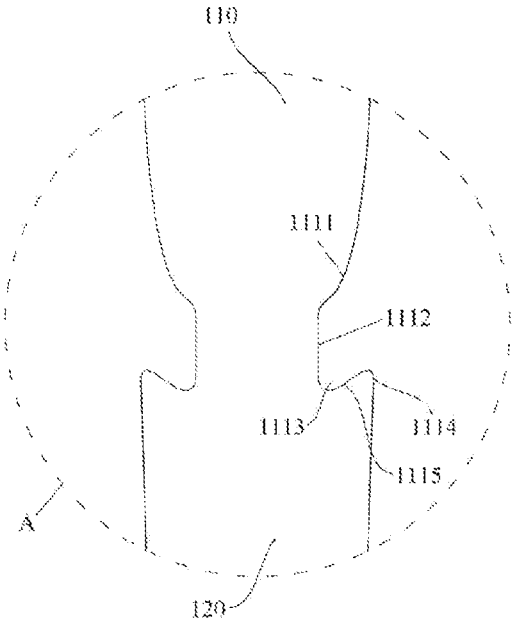
FIG. 4 is a partially enlarged view of part A of FIG. 3.
Figure 5:
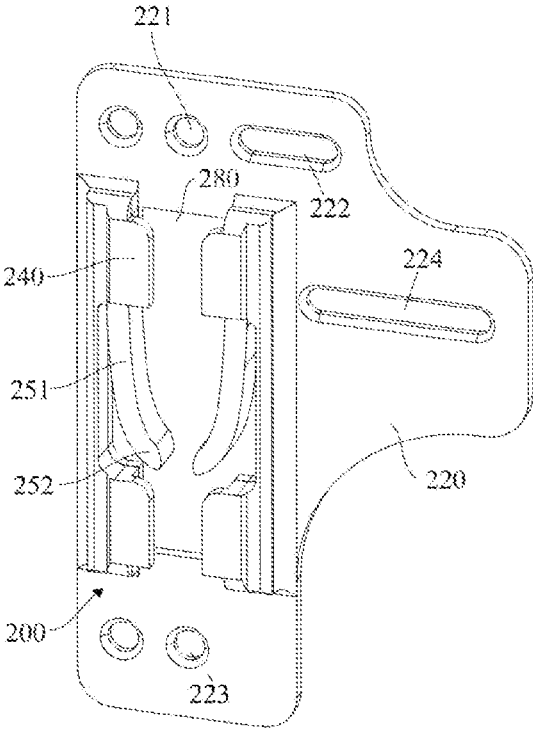
FIG. 5 is a structural diagram showing a front axis side of a mounting plate in the present disclosure.
Figure 6:
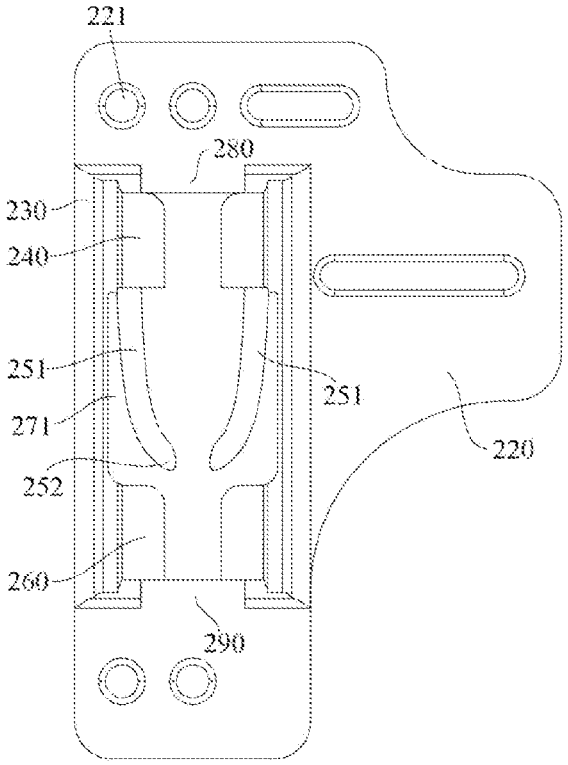
FIG. 6 is a front view of the mounting plate in the present disclosure.
Figure 7:
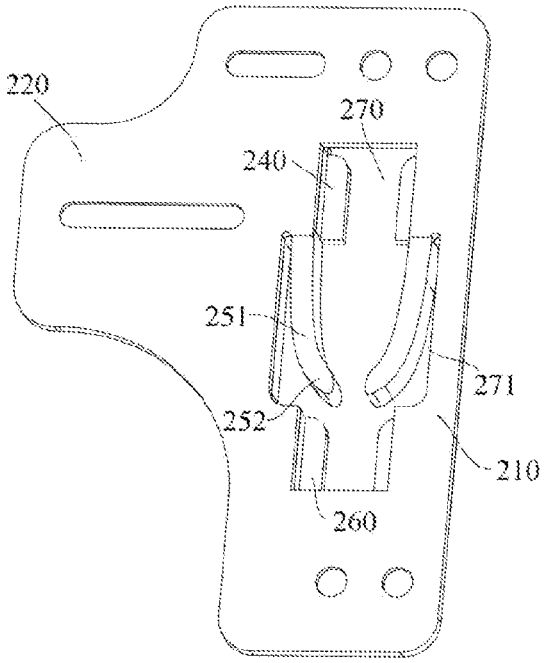
FIG. 7 is a structural diagram showing a rear axis side of the mounting plate in the present disclosure.
Figure 8:
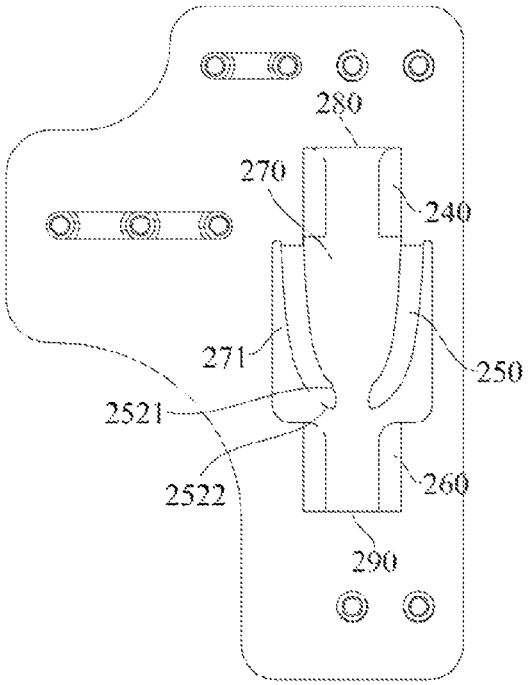
FIG. 8 is a rear view of the mounting plate in the present disclosure.

Referring to FIG. 2, the notches are designed to assist the bending with the bending position 135, and most importantly, if the hanging member 100 is required to be detached from the mounting plate 200, due to the design of the limit end in the locating groove 111, the hanging member 100 can only be detached from above the mounting plate 200. Therefore, when an uppermost end of the long strip 110 passes through the sliding channel, the hook portion 130 is bound to contact with the anti-falling component as well as the elastic member 250, at the same time, the notches are provided for the anti-falling component and the elastic member 250 to pass through, so that the hanging member 100 can be smoothly detached from above the mounting plate 200.

For convenience of description, the upper and lower ends of the clamping head 252 are respectively named as a clamping upper end 2521 and a clamping lower end 2522. When the clamping head 252 is embedded into the locating groove 111, the clamping upper end 2521 abuts on an inner wall of the guiding end 1111, and the locking lower end 2522 abuts on the valley bottom end 1113.

As another preferred embodiment of the present embodiment, the plate body is provided with a plurality of mounting holes arranged at intervals, and the mounting holes are used for fastening and mounting the plate body to a rear side of the door mirror 300 with the fasteners 500. It should be noted that the fasteners 500 herein may employ, but are not limited to, screws, nails, rivets, clips, etc., which cooperate with the mounting holes to form a detachable connection, a fixed connection, and/or combinations thereof. In practical applications, for convenience, a self-tapping screw is generally adopted to carry out the installation. Referring to FIG. 1, only the plate body needs to be placed in a suitable position and adjusted to a suitable angle, the self-tapping screw can be installed in the mounting hole to fix the plate body.

In order to make the connection between the plate body and the rear side of the door mirror 300 more stable, the plate body is generally divided into the main plate body 210 and a plurality of extension plates disposed on a peripheral side of the main plate body 210, and the mounting holes are distributed at a center of gravity of each extension plate. In this embodiment, there are three extension plates, the base 230 is installed on the main plate body 210, and the three extension plates are respectively arranged on an upper side, a lower side and a left side/right side of the main plate body 210. The mounting holes include a first mounting hole 221, a second mounting hole 222, a third mounting hole 223, and a fourth mounting hole 224, wherein the first mounting hole 221 and the second mounting hole 222 are provided on the upper extension plate, the third mounting hole 223 is provided on the lower extension plate, and the fourth mounting hole 224 is provided on the left/right extension plate.

Figure 9:
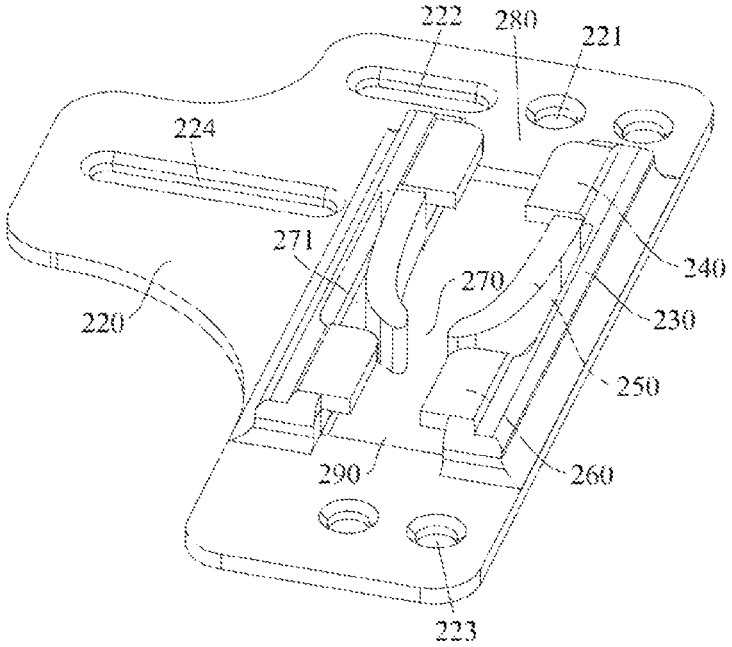
FIG. 9 is a structural diagram showing a front axial side of the mounting plate in a state in which the mounting plate shown in FIG. 5 is disposed symmetrically.
Figure 10:
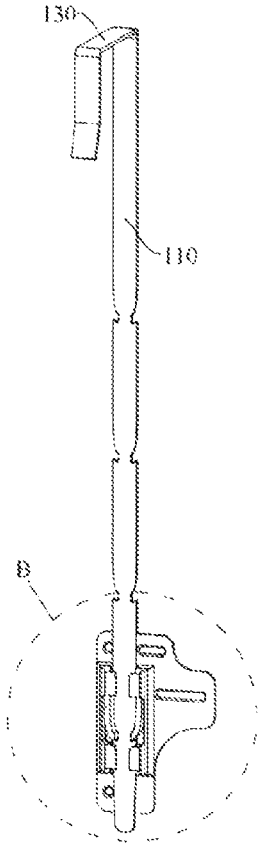
FIG. 10 is a schematic structural view of the hanging member assembled in the mounting plate in the present disclosure.
Figure 11:
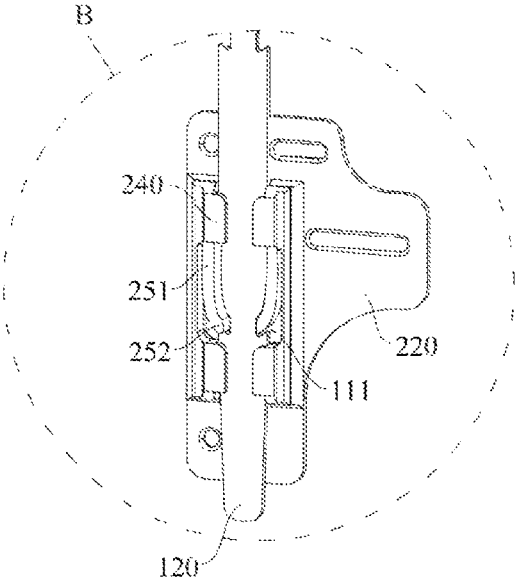
FIG. 11 is a partially enlarged view of part B in FIG. 10.
Figure 12:
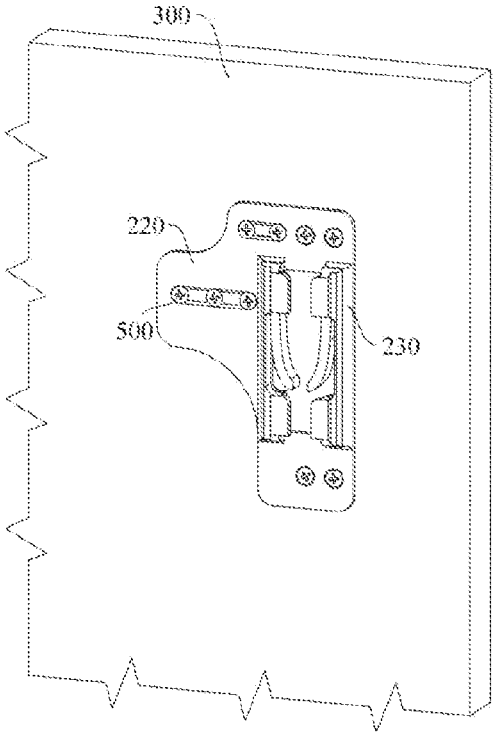
FIG. 12 is a schematic structural view of the mounting plate installed on a back of the door mirror in the present disclosure.
Figure 13:
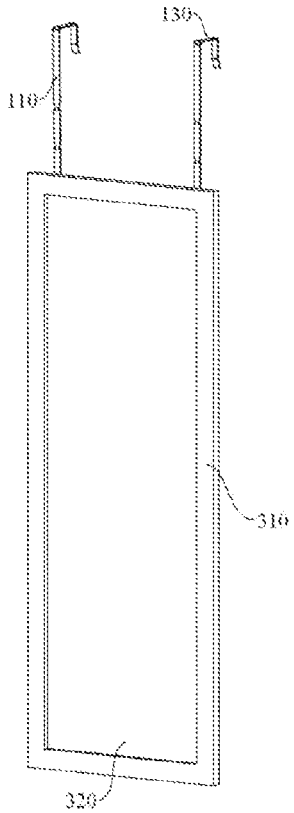
FIG. 13 is a structural view showing an overall front axis side of the present disclosure installed on the integral door mirror.
Figure 14:
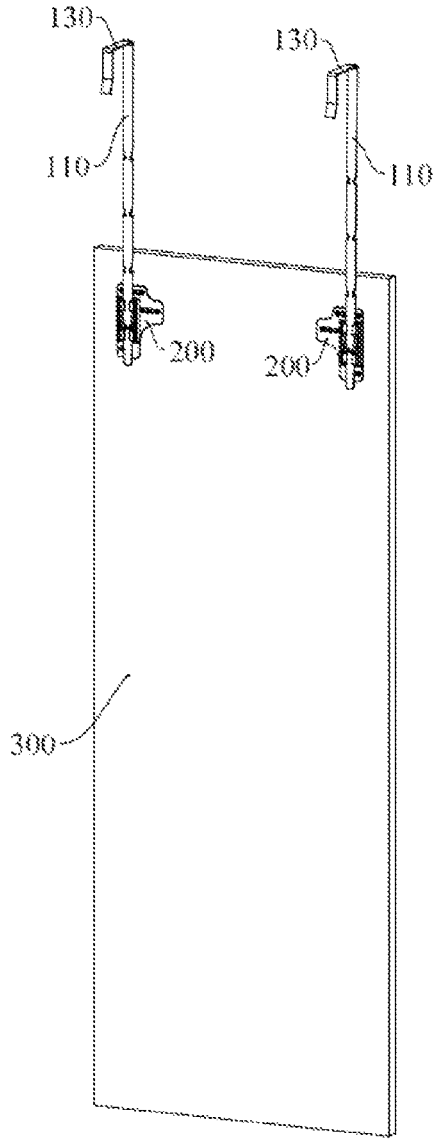
FIG. 14 is a structural view showing an overall rear axis side of the present disclosure installed on the integral door mirror.
Figure 15:
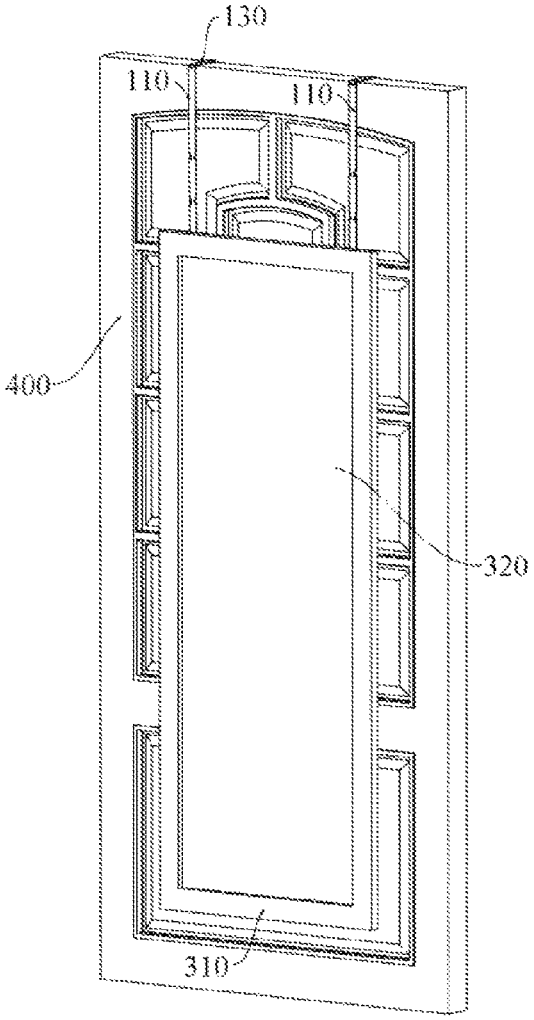
FIG. 15 is a schematic structural view of a door mirror installed on a door plank by a hanging auxiliary device according to the present disclosure.

More specifically, referring to FIG. 9, the left and right sides of the sliding channel are respectively provided with an opening 271 for elastic deformation and displacement of the elastic body 251, and the plate body is provided with a through hole 270 communicating with the sliding channel. Here, the opening 271 is also generally connected to the through hole 270, which is equivalent to the through hole 270 covering the entire or most of the area where the opening 271 and the sliding channel are located, and thus the production cost is effectively reduced without affecting the overall strength of the plate body.

Working principle: after the plate body is fixed on the rear side of the door mirror 300 through the self-tapping screw and the mounting hole, i.e. the long strip 110 of the hanging member 100 can be inserted into the sliding channel from an end of the plug inlet 280 from top to bottom and the direction of the hook portion 130 at this time is ensured to face away from a side of the mirror surface 320. At this time, the tip end 121 of the plug 120 will first pass through the plug inlet 280 and enter into the sliding channel. Since two sides in the length direction of the plug 120 are contracted inward from top to bottom, the plug 120 can smoothly enter into the sliding channel when the long strip 110 is further displaced downward. When the plug 120 is completely inserted into the sliding channel, the locating groove 111 closest to the plug 120 is immediately inserted into the sliding channel. When the tip end 121 moves downward to the position of the clamping head 252, the clamping upper end 2521 of the clamping head 252 first contacts the tip end 121, since the clamping upper end 2521 of the clamping head 252 is guided in a gentle arc shape, when the tip end 121 moves further downward, the tip end 121 and the side wall of the plug 120 will abut against and apply a pressing force to the clamping head 252 to expand outwardly, and the elastic body 251 is deformed after being pressed, and enters into the opening 271. When the long strip 110 continues to be displaced downward and the locating groove 111 is displaced to the position of the clamping head 252, the clamping head 252 loses the pressing force applied by the side wall of the plug 120 at the moment when the clamping head 252 reaches the locating groove 111. At this time, the elastic body 251 restores the elastically deformation, and the clamping head 252 springs back and enters into the locating groove 111. The upper and lower ends of the locating groove 111 are a guiding end 1111 and a limit end, respectively. At this time, there are two cases:

case 1: the door mirror 300 has reached a predetermined height, and it is not necessary to adjust the relative positions of the long strip 110 and the mounting plate 200. At this time, the force bearing point overcoming the gravity of the door mirror 300 and the mounting plate 200 will be shifted to the connection position of the locating groove 111 and the clamping head 252. In general, a plurality of mounting plates 200 are installed on the rear side of the door mirror 300, and each mounting plate 200 is correspondingly provided with a hanging member 100, so that the force is distributed continuously, and the force distributed evenly across each hanging auxiliary device is not large. When the door mirror 300 has no additional force, the elastic members 250 on each mounting plate cannot be elastically deformed by gravity alone, so that the clamping head cannot be separated from the locating groove 111, and the height of the door mirror 300 can be finally positioned; and case 2: when the door mirror 300 has not reach the predetermined height, it is optional to continue the downward displacement of the long strip 110 relative to the mounting plate 200 (as described in case 1, the force acting on a single hanging auxiliary device is not large, When it is necessary to push the long strip 110 to continue the displacement, it is relatively easy to perform the displacement only by human force), at this time, the clamping upper end 2521 of the clamping head 252 is separated from the locating groove 111 by a guide of the guiding end 1111, and the clamping lower end 2522 is also separated from the limit end, and the elastic body 251 continues to be elastically deformed after being pressed until the latching head 252 enters into the next locating groove 111.

The above-mentioned hanging auxiliary device for door mirror of the present disclosure is only a preferred embodiment of the present disclosure, which does not limit the scope of the patent of the present disclosure. Under the inventive concept of the present disclosure, the equivalent structure transformation made by using the contents of the specification and drawings of the present disclosure, or direct/indirect application in other relevant technical fields is included in the patent protection scope of the present disclosure.

What is claimed is:

1. A hanging auxiliary device for a door mirror for assisting in hanging the door mirror to a door plank, wherein the hanging auxiliary device comprises a hanging member and a mounting plate, wherein the hanging member comprises:

a long strip being a flat thin plate and having a plurality of locating groove groups arranged at intervals along a length direction thereof, and each of the plurality of locating groove groups comprising two locating grooves which are arranged symmetrically on two sides of the long strip along a width direction thereof, and upper and lower ends of each of the two locating grooves being a guiding end and a limit end; a lower end of the strip being provided with a plug, and two sides in a length direction of the plug are shrunk inward from top to bottom until a tip end is formed at a lowest end of the plug; a bottom of each of the two locating grooves is configured to be an abutment inner end, and the guiding end extends outward from an upper end of the abutment inner end in a gentle slope, and the limit end comprises a lower sealing slope, a valley bottom end disposed on an inner side of the lower sealing slope, and a peak end disposed on an outer side of the lower sealing slope, wherein the valley bottom end is located at a lower end of the abutment inner end, and the valley bottom end has a lower horizontal height than the peak end; and a hook portion integrally mounted to an upper end of the long strip;

the mounting plate comprises:

a plate body;

two bases which are arranged on one side of the plate body and spaced apart from each other;

a sliding channel between the two bases, through which the long strip passes;

an anti-falling component arranged at one side of an extending direction of the sliding channel for preventing the long strip from falling out of the sliding channel; and two elastic members which are respectively arranged at left and right sides of the sliding channel; each of the two elastic members comprises:

an elastic body extending in a curved shape and having one end fixed to one of the two bases or the anti-falling component; and a clamping head located at an extended end of the elastic body;

wherein during the long strip passing through the sliding channel from top to bottom, the two elastic members have an expanded state and a normal state; in the expanded state, the clamping heads of the two elastic members abut on respective sides of the long strip along the length direction thereof through elastic deformation of the two elastic members; and in the normal state, the two elastic members restore the deformation, and the clamping heads of the two elastic members are adaptively embedded into the respective locating grooves of a corresponding locating groove group; and the guiding ends of the locating grooves of the corresponding locating groove group are used to assist in guiding the clamping heads of the two elastic members away from the respective locating grooves of the corresponding locating groove group, and the limit ends of the locating grooves of the corresponding locating groove group are used to limit downward movement of the clamping heads of the two elastic members.

2. The hanging auxiliary device for a door mirror according to claim 1, the long strip passes through the sliding channel along a vertical direction, the clamping head of one of the two elastic members and the clamping head of the other of the two elastic members are bilaterally symmetrical along a centerline in the length direction of the long strip.

3. The hanging auxiliary device for door mirrors according to claim 2, wherein the anti-falling component comprises two sets of limit blocks, and each set of the limit blocks comprises two limit blocks fixedly mounted on the two bases respectively.

4. The hanging auxiliary device for a door mirror according to claim 1, wherein the hook portion comprises an upper transverse portion which is bent and extends from the upper end of the long strip to one side, and a stop portion which is downwardly bent and extends from a free end of the upper transverse portion, a lower end of the stop portion is integrally provided with a leading portion which is folded outwardly, the upper transverse portion, the stop portion, and the long strip together surround to form a door plank bayonet opening that opens downwardly.

5. The hanging auxiliary device for a door mirror according to claim 4, wherein a bending portion is provided at a connecting portion of the long strip and the upper transverse portion.

6. The hanging auxiliary device for a door mirror according to claim 1, wherein the plate body is provided with a plurality of mounting holes, and the mounting holes are used for fastening and mounting the plate body to a rear side of the door mirror with fasteners.

7. The hanging auxiliary device for a door mirror according to claim 6, wherein the plate body comprises an integrally formed and co-planar main plate body and at least one extension plate, the two bases are installed on the main plate body, and the mounting holes are located on the at least one extension plate.

8. The hanging auxiliary device for a door mirror according to claim 1, wherein two openings are respectively defined on left and right sides of the sliding channel for elastic deformation and displacement of the two elastic members, and the plate body is provided with a through hole communicating with the sliding channel.

* * * * *